US009233772B2

(12) United States Patent
Kuzma et al.

(10) Patent No.: US 9,233,772 B2
(45) Date of Patent: Jan. 12, 2016

(54) SPIRALLY THREADED MOLDED BOTTLE NECK HAVING AREAS OF REDUCED WALL THICKNESS

(75) Inventors: Gene J. Kuzma, Powell, OH (US); Jonathan Davia, Dublin, OH (US)

(73) Assignee: GK Packaging, Inc., Plain City, OH (US)

( * ) Notice: Subject to any disclaimer, the term of this patent is extended or adjusted under 35 U.S.C. 154(b) by 0 days.

(21) Appl. No.: 13/152,663

(22) Filed: Jun. 3, 2011

(65) Prior Publication Data

US 2012/0305516 A1 Dec. 6, 2012

(51) Int. Cl.
*B65B 7/28* (2006.01)
*B65D 1/02* (2006.01)

(52) U.S. Cl.
CPC ..... *B65D 1/0246* (2013.01)

(58) Field of Classification Search
CPC ..... B65D 1/0246
USPC ..... 215/42–44, 46, 217, 222–223, 240, 215/40–41, 330–331; 220/288; 222/556
See application file for complete search history.

(56) References Cited

U.S. PATENT DOCUMENTS

| | | | | | |
|---|---|---|---|---|---|
| 3,147,876 | A * | 9/1964 | Lepore | 215/261 |
| 3,499,567 | A * | 3/1970 | Spotts | 215/42 |
| 3,511,403 | A * | 5/1970 | Braun | 215/330 |
| 4,007,848 | A * | 2/1977 | Snyder | 215/44 |
| 4,427,126 | A | 1/1984 | Ostrowsky | |
| 4,721,221 | A | 1/1988 | Barriac | |
| 4,738,370 | A | 4/1988 | Urmston et al. | |
| 4,747,502 | A | 5/1988 | Luenser | |
| 4,948,001 | A | 8/1990 | Magly | |
| 5,551,582 | A * | 9/1996 | Robinson | 215/216 |
| 5,676,270 | A * | 10/1997 | Roberts | 215/330 |
| 5,722,545 | A * | 3/1998 | Rinne | 215/44 |
| 5,810,209 | A * | 9/1998 | Foster | 222/383.1 |
| 5,869,155 | A | 2/1999 | Krall | |
| 6,659,294 | B1 * | 12/2003 | Simard | 211/181.1 |
| 6,948,640 | B2 * | 9/2005 | Pennaneac'h et al. | 222/383.1 |
| 7,900,789 | B2 * | 3/2011 | Johnston et al. | 215/330 |
| 2002/0027123 | A1 | 3/2002 | Druitt | |
| 2004/0055991 | A1 | 3/2004 | Luch | |
| 2005/0184433 | A1 | 8/2005 | Druit | |
| 2005/0263476 | A1 * | 12/2005 | Harrison et al. | 215/44 |
| 2007/0205175 | A1 * | 9/2007 | Darr et al. | 215/40 |
| 2008/0257849 | A1 * | 10/2008 | Farrar et al. | 215/222 |
| 2008/0296251 | A1 * | 12/2008 | Johnston et al. | 215/330 |
| 2008/0314856 | A1 * | 12/2008 | Penny et al. | 215/252 |

* cited by examiner

*Primary Examiner* — Anthony Stashick
*Assistant Examiner* — James M Van Buskirk
(74) *Attorney, Agent, or Firm* — Michael J. Gallagher; David J. Dawsey; Gallagher & Dawsey Co., LPA

(57) ABSTRACT

A screw-type bottle neck having areas of reduced wall thickness is provided. The bottle neck includes a neck opening having a neck opening axis, a neck interior surface, and a neck exterior surface. The neck exterior surface includes at least one spiral thread portion. The bottle neck has at least one area of first neck thickness having a first neck thickness, and at least one area of second neck thickness having a second neck thickness. The second neck thickness is greater than the first neck thickness. The difference between the first neck thickness and the second neck thickness allows for a substantial reduction in the amount of material required to manufacture the bottle neck.

20 Claims, 11 Drawing Sheets

SPIRALLY THREADED MOLDED BOTTLE NECK HAVING AREAS OF REDUCED WALL THICKNESS

TECHNICAL FIELD

The present disclosure relates to containers and container closures, and more particularly, to a spirally threaded molded bottle neck having areas of reduced wall thickness, thereby reducing the total materials and manufacturing time needed for construction of the bottle.

BACKGROUND OF THE INVENTION

Containers and container closures are manufactured with a variety of standard sizes, but may also be manufactured with custom sizes. The sizes are based on certain measurements of the container neck (N). Referring now to FIG. 1, a container neck (N) and closure cap (C) are shown. The container neck (N) has threads on its outer wall. As seen in FIG. 1, the container neck (N) has an inside diameter, referred to as the "I" dimension, an outside diameter, referred to as the "E" dimension, and an outer thread diameter, referred to as the "T" dimension.

The closure cap (C) must mate with the container neck (N) properly in order to provide a seal. A number of different types of seals between container necks (N) and closure caps (C) are available including, but not limited to, plug seals, land seals using a bead, and land seals using an edge of material. Plug seals and land seals using a bead require proper alignment between the container neck (N) and closure cap (C). This proper alignment is achieved by controlling the "E" and "T" dimensions of the container neck (N) and closure cap (C).

The container neck (N) is generally the thickest portion of the container, and as a result, often uses the most material per inch of the container. The container neck (N) generally requires more time for cooling during production due to its greater thickness. Furthermore, the molding cycle time for the container is generally controlled by the thickness of the portion being molded. As a result, it would be desirable to reduce the amount of material used in making the container without affecting the performance or integrity of the seal between the container neck (N) and cap closure (C). It would also be desirable to reduce the thickness of the container neck (N) to reduce material costs and manufacturing costs, while still maintaining the effective "I" dimension and the effective "E" dimension of the container neck (N) that are capable of properly aligning with standard and custom closure caps (C).

Therefore, there is a need in the art for a container, such as a bottle, with a neck having areas of reduced wall thickness that remains capable of mating properly with standard or custom closure caps (C) to provide an effective seal. The presently disclosed spirally threaded molded bottle neck having areas of reduced wall thickness solves this need.

SUMMARY OF THE INVENTION

In its most general configuration, the presently disclosed spirally threaded molded bottle neck having areas of reduced wall thickness advances the state of the art with a variety of new capabilities and overcomes many of the shortcomings of prior devices in new and novel ways. The presently disclosed spirally threaded molded bottle neck having areas of reduced wall thickness overcomes the shortcomings and limitations of the prior art in any of a number of generally effective configurations.

The present disclosure relates to a spirally threaded molded bottle neck having areas of reduced wall thickness, hereafter referred to simply as "the bottle neck". The bottle neck includes a neck opening having a neck opening axis, a neck opening top, and a neck opening bottom; a neck interior surface; and a neck exterior surface. The neck exterior surface includes at least one spiral thread portion. The portions of the neck exterior surface that do not comprise the spiral thread portion, that is, the portions most commonly thought of as the exterior wall of the bottle neck, include at least a first exterior wall interthread portion and at least a second exterior wall interthread portion.

The bottle neck has at least one area of first neck thickness having a first neck thickness that is measured orthogonally between a first point on the neck exterior surface in the first exterior wall interthread portion and the neck interior surface. Further, the bottle neck includes at least one area of second neck thickness having a second neck thickness that is measured orthogonally between a second point on the neck exterior surface in the second exterior wall interthread portion and the neck interior surface. The second neck thickness is greater than the first neck thickness, which generally results in a substantial reduction in the amount of material required to construct the bottle neck.

BRIEF DESCRIPTION OF THE DRAWINGS

Without limiting the scope of the present spirally threaded molded bottle neck having areas of reduced wall thickness claimed below and referring now to the drawings and figures:

Figure 1:
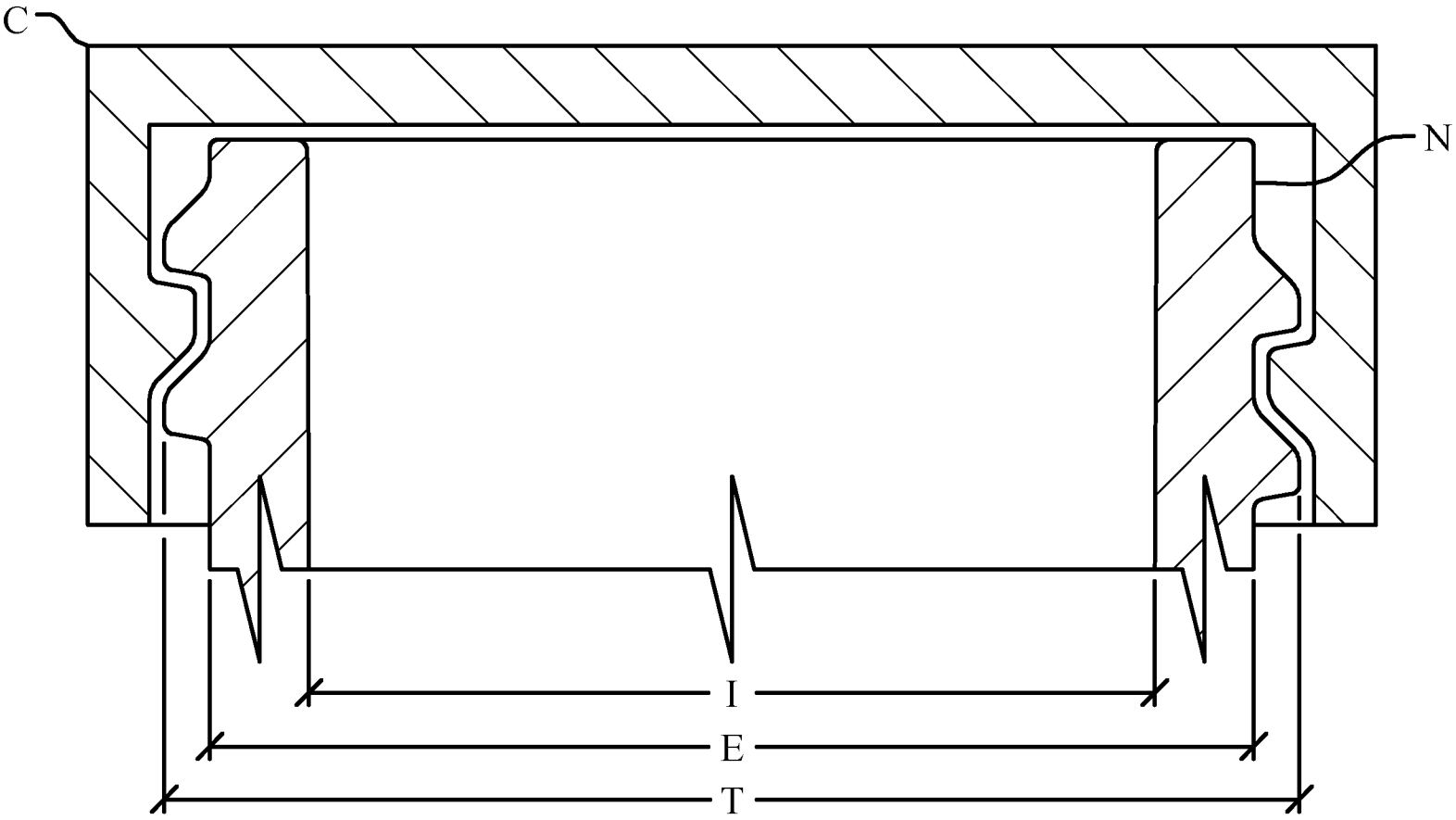
PRIOR ART Fig. 1
FIG. 1 is a partial cross sectional view of a prior art container neck and closure cap, not to scale.

These drawings are provided to assist in the understanding of the exemplary embodiments of the spirally threaded molded bottle neck having areas of reduced wall thickness as described in more detail below and should not be construed as unduly limiting the bottle neck. In particular, the relative spacing, positioning, sizing and dimensions of the various elements illustrated in the drawings are not drawn to scale and may have been exaggerated, reduced or otherwise modified for the purpose of improved clarity. Those of ordinary skill in the art will also appreciate that a range of alternative configurations have been omitted simply to improve the clarity and reduce the number of drawings.

DETAILED DESCRIPTION OF THE INVENTION

The spirally threaded molded bottle neck having areas of reduced wall thickness, hereafter referred to simply as "the bottle neck (10)", enables a significant advance in the state of the art. The preferred embodiments of the bottle neck (10) accomplish this by new and novel arrangements of elements and methods that are configured in unique and novel ways and which demonstrate previously unavailable but preferred and desirable capabilities. The description set forth below in connection with the drawings is intended merely as a description of the presently preferred embodiments of the bottle neck (10), and is not intended to represent the only form in which the bottle neck (10) may be constructed or utilized. The description sets forth the designs, functions, means, and methods of implementing the bottle neck (10) in connection with the illustrated embodiments. It is to be understood, however, that the same or equivalent functions and features may be accomplished by different embodiments that are also intended to be encompassed within the spirit and scope of the presently disclosed bottle neck (10).

Figure 2:
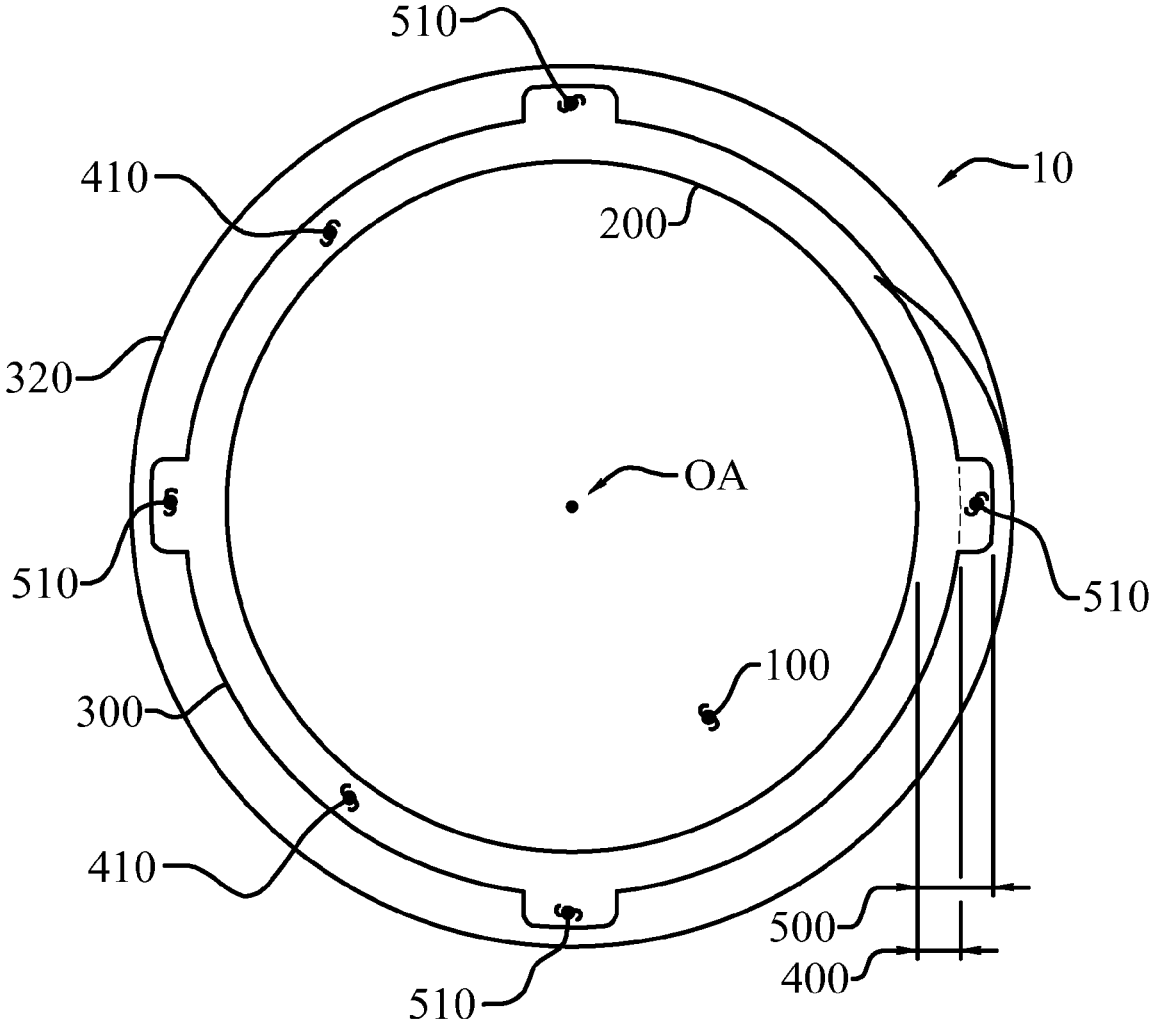
FIG. 2 is a top plan view of an embodiment of a spirally threaded molded bottle neck having areas of reduced wall thickness, not to scale.

Referring generally to FIGS. 1-6, a bottle with a spirally threaded molded bottle neck (10) may have at least two portions of differing bottle neck (10) wall thickness. The bottle neck (10) includes a neck opening (100) having a neck opening axis (OA), a neck opening top (110), and a neck opening bottom (120); a neck interior surface (200); and a neck exterior surface (300), as seen in FIG. 2. Although the specification refers to "bottle" for purposes of clarity, it should be noted that "bottle" is used herein to refer to any type of container that utilizes a screw-type closure. Moreover, although the bottle neck (10) is shown and described as having a circular shape, those with skill in the art will appreciate that other shapes may be utilized including, but not limited to, truncated circular cone, oval, truncated oval cone, square, or rectangular, just to name a few.

Figure 3:
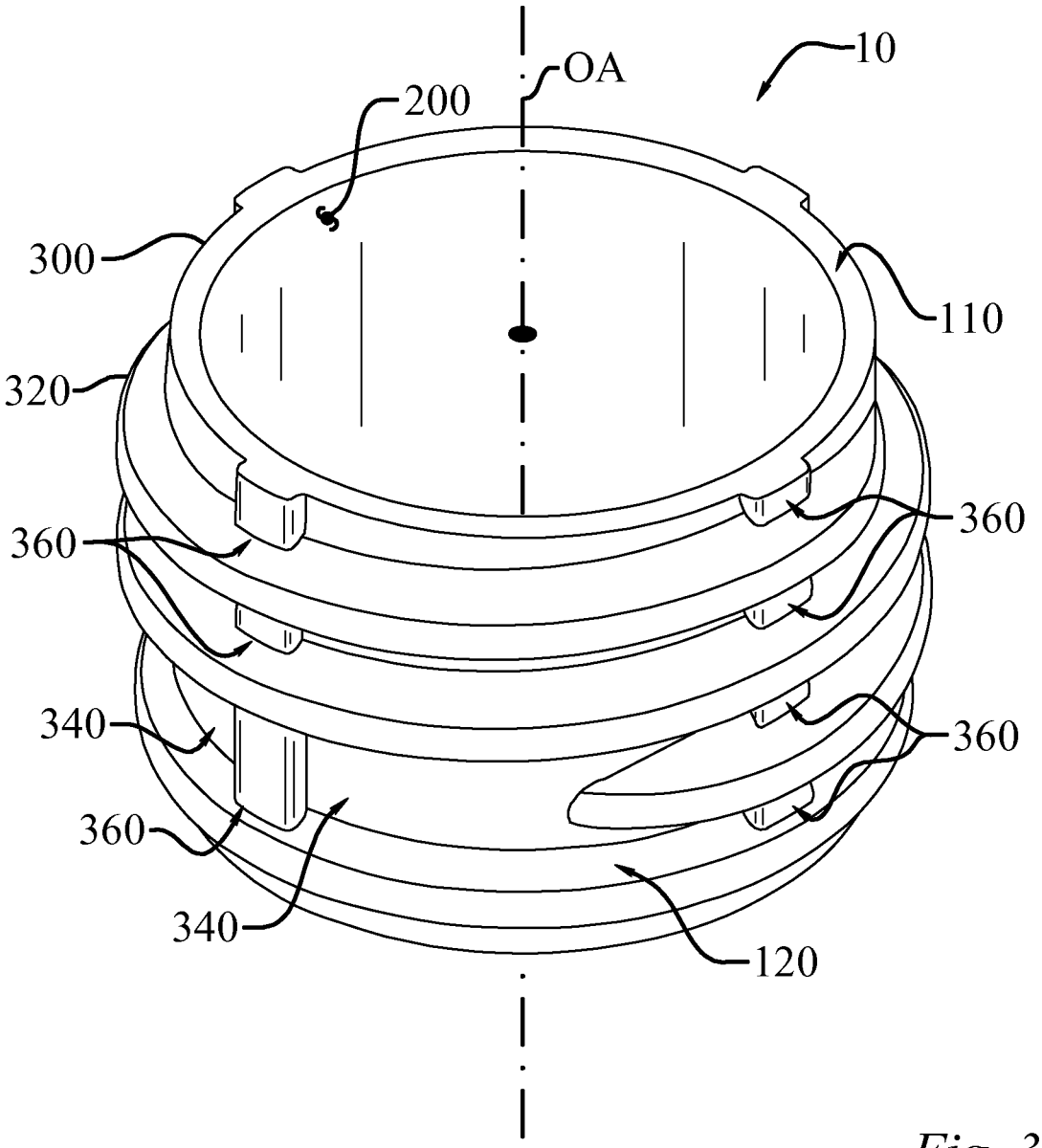
FIG. 3 is a perspective view of an embodiment of a spirally threaded molded bottle neck having areas of reduced wall thickness, not to scale.
Figure 4:
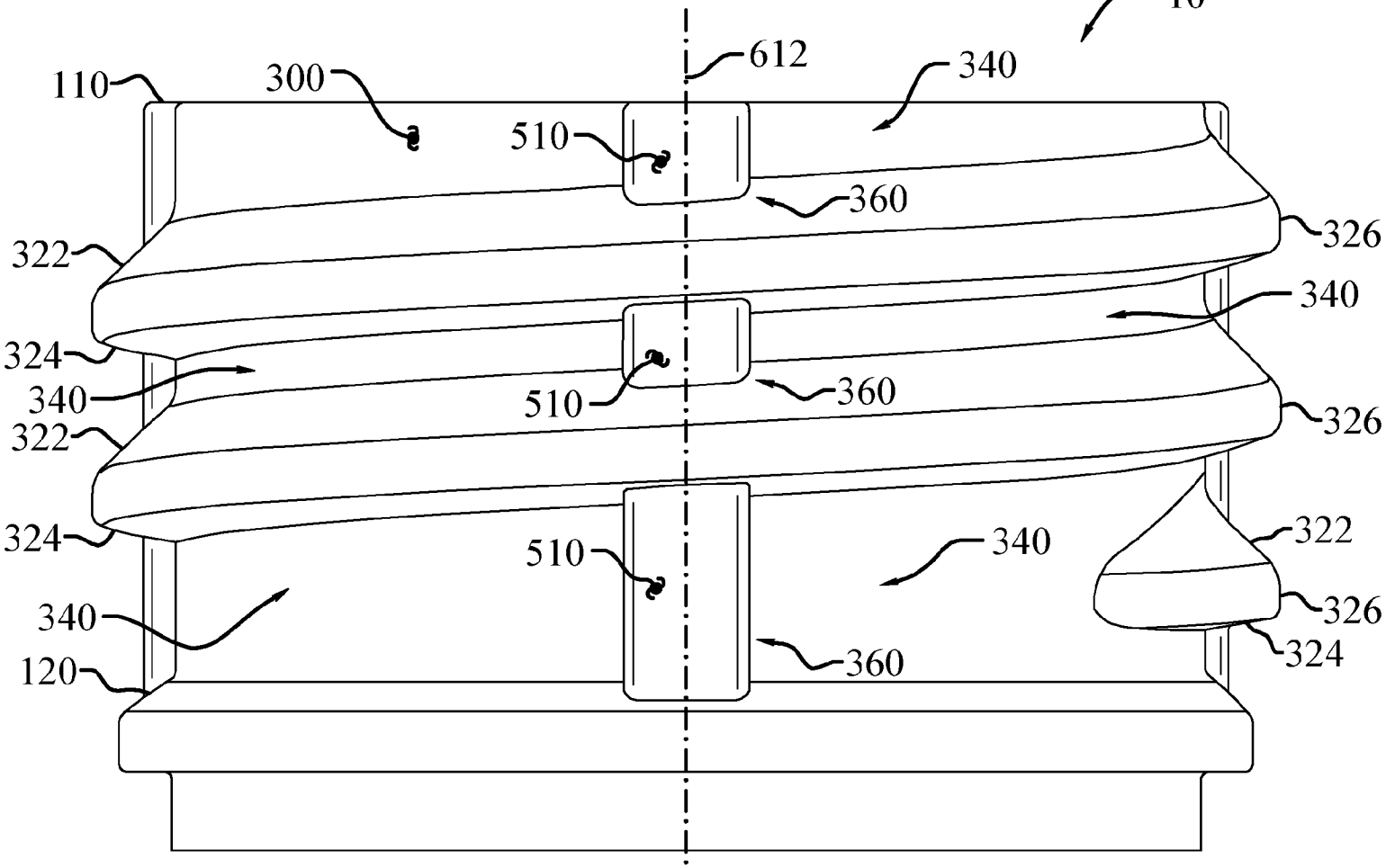
FIG. 4 is a side elevation view of an embodiment of a spirally threaded molded bottle neck having areas of reduced wall thickness, not to scale.

As seen in FIGS. 2-4, the neck exterior surface (300) includes at least one spiral thread portion (320). The at least one spiral thread portion (320) may have a superior thread aspect (322), an inferior thread aspect (324), and a lateral thread aspect (326). The portions of the neck exterior surface (300) that do not comprise the spiral thread portion (320), that is, the portions most commonly thought of as the exterior wall of the bottle neck (10), include at least a first exterior wall interthread portion (340) and at least a second exterior wall interthread portion (360), seen well in FIGS. 3 and 4. In some embodiments there may be additional interthread portions (340, 360), as this specification is not intended to indicate that there may be only two interthread portions (340, 360).

With reference now to FIG. 2, the bottle neck (10) has at least one area of first neck thickness (410) having a first neck thickness (400) that is measured orthogonally between a first point on the neck exterior surface (300) in the first exterior wall interthread portion (340) and the neck interior surface (200). The bottle neck (10) also includes at least one area of second neck thickness (510) having a second neck thickness (500) that is measured orthogonally between a second point on the neck exterior surface (300) in the second exterior wall interthread portion (360) and the neck interior surface (200). As seen in FIG. 2, the second neck thickness (500) is greater than the first neck thickness (400). In some embodiments there may be additional areas of neck thickness (410, 510), as this specification is not intended to indicate that there may be only two areas of neck thickness (410, 510).

In one embodiment, as seen in FIGS. 3-6, the at least one area of second neck thickness (510) is continuous with at least one point on the superior thread aspect (322) and one point on the inferior thread aspect (324). Thus, consecutive turns of the spiral thread portion (320) may have the interthread space between such turns, in part, filled with the area of second neck thickness (510).

The at least one area of second neck thickness (510) is intended to create surfaces on the neck exterior surface (300), i.e., the second exterior wall interthread portion (360), that correspond to the "E" dimension of a standard (or custom) neck finish. This ensures that a proper alignment is maintained between the bottle neck (10) and a corresponding standard closure so that the bottle neck (10) and closure mate properly. As seen in FIG. 2, the at least one area of first neck thickness (410) has a first neck thickness (400) that is less than the second neck thickness (500), which results in a substantial reduction in the amount of material required to construct the bottle neck (10).

It should be noted that no particular ratio of thickness is required between the first neck thickness (400) and the second neck thickness (500). One skilled in the art will know the appropriate thicknesses to utilize that result in substantial material and manufacturing costs, while still providing a bottle neck (10) that may be used with standard (or custom) closures. However, in one embodiment, the second neck thickness (500) is at least three times greater than the first neck thickness (400). In another embodiment, the second neck thickness (500) is at least two times greater than the first neck thickness (400). In yet another embodiment, the second neck thickness (500) is at least 1.1 times greater than the first neck thickness (400).

Figure 2A:
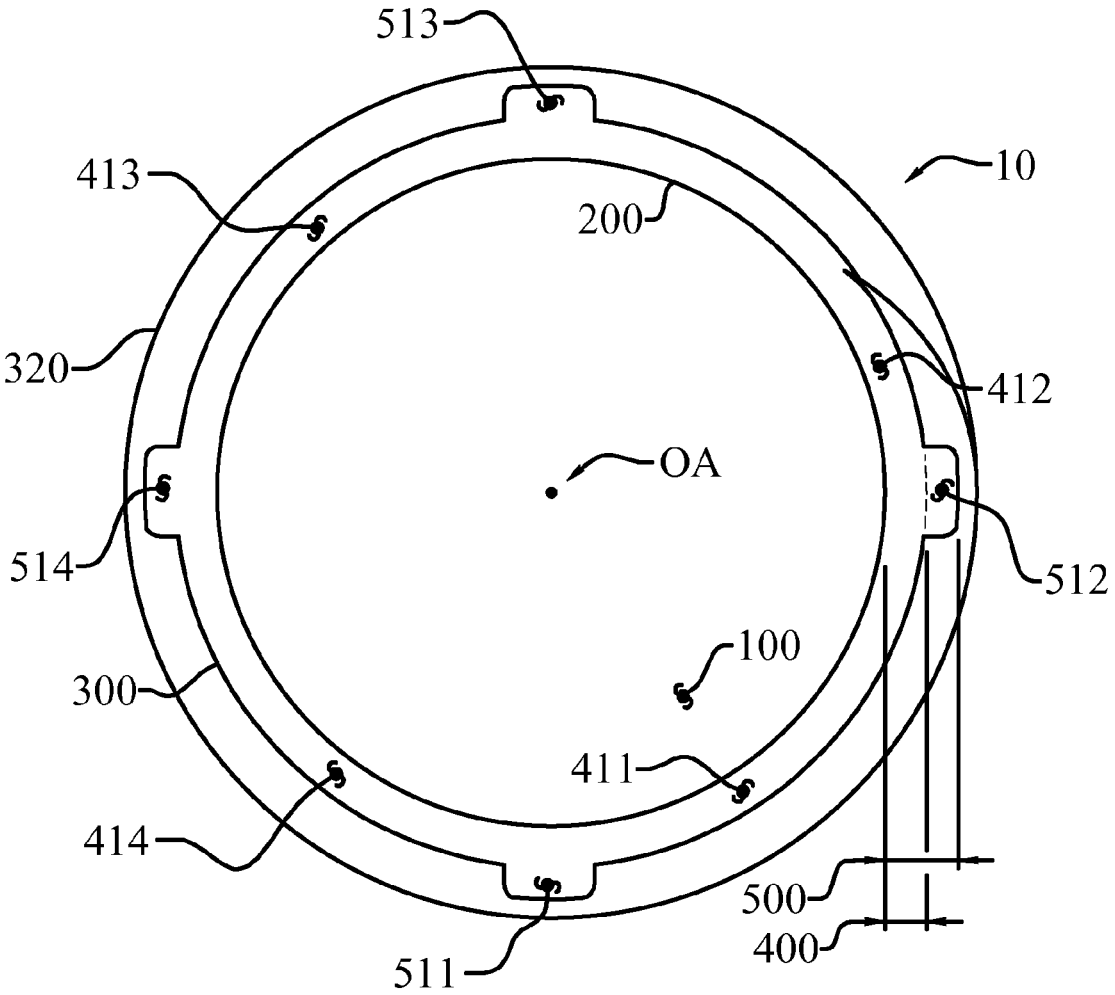
FIG. 2*a* is a top plan view of an embodiment of a spirally threaded molded bottle neck having areas of reduced wall thickness, not to scale.

As noted, there is no requirement that there only be a single area of first neck thickness (410). In some embodiments, the at least one area of first neck thickness (410) may further include at least a first area of first neck thickness (411) and at least a second area of first neck thickness (412). Similarly, the at least one area of second neck thickness (510) may further include at least a first area of second neck thickness (511) and at least a second area of second neck thickness (512). For example, and as seen in FIG. 2*a*, in one particular embodiment, the bottle neck (10) includes a first area of first neck thickness (411) and a first area of second neck thickness (511), a second area of first neck thickness (412) and a second area of second neck thickness (512), a third area of first neck thickness (413) and a third area of second neck thickness (513), and a fourth area of first neck thickness (414) and a fourth area of second neck thickness (514). One with skill in the art will appreciate that the bottle neck (10) may include even further areas of first and second neck thickness (410, 510). In one embodiment, the at least one area of second neck thickness (510) further comprises at least two areas of differing second neck thickness (500).

Figure 3A:
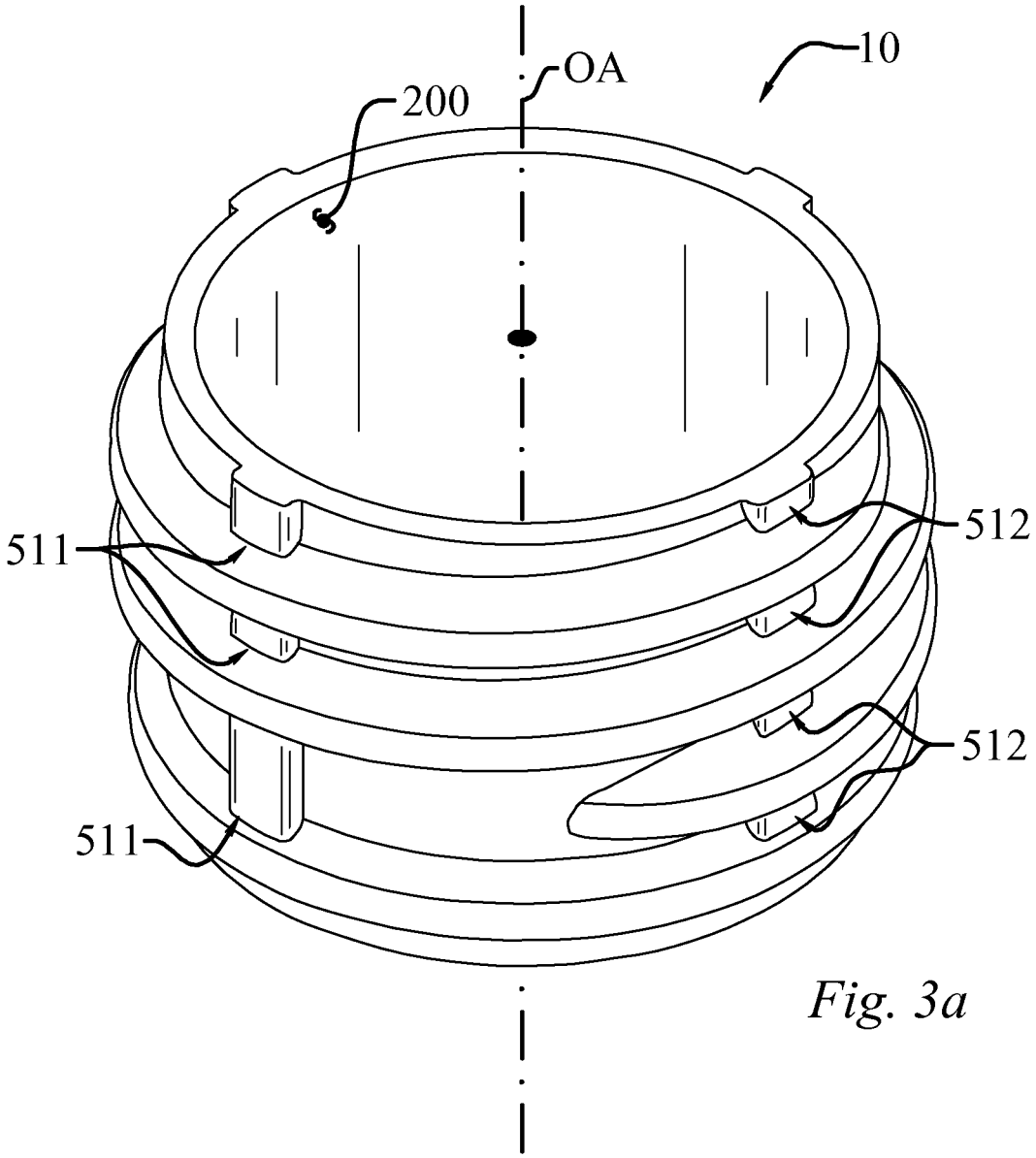
FIG. 3*a* is a perspective view of an embodiment of a spirally threaded molded bottle neck having areas of reduced wall thickness, not to scale.
Figure 4A:
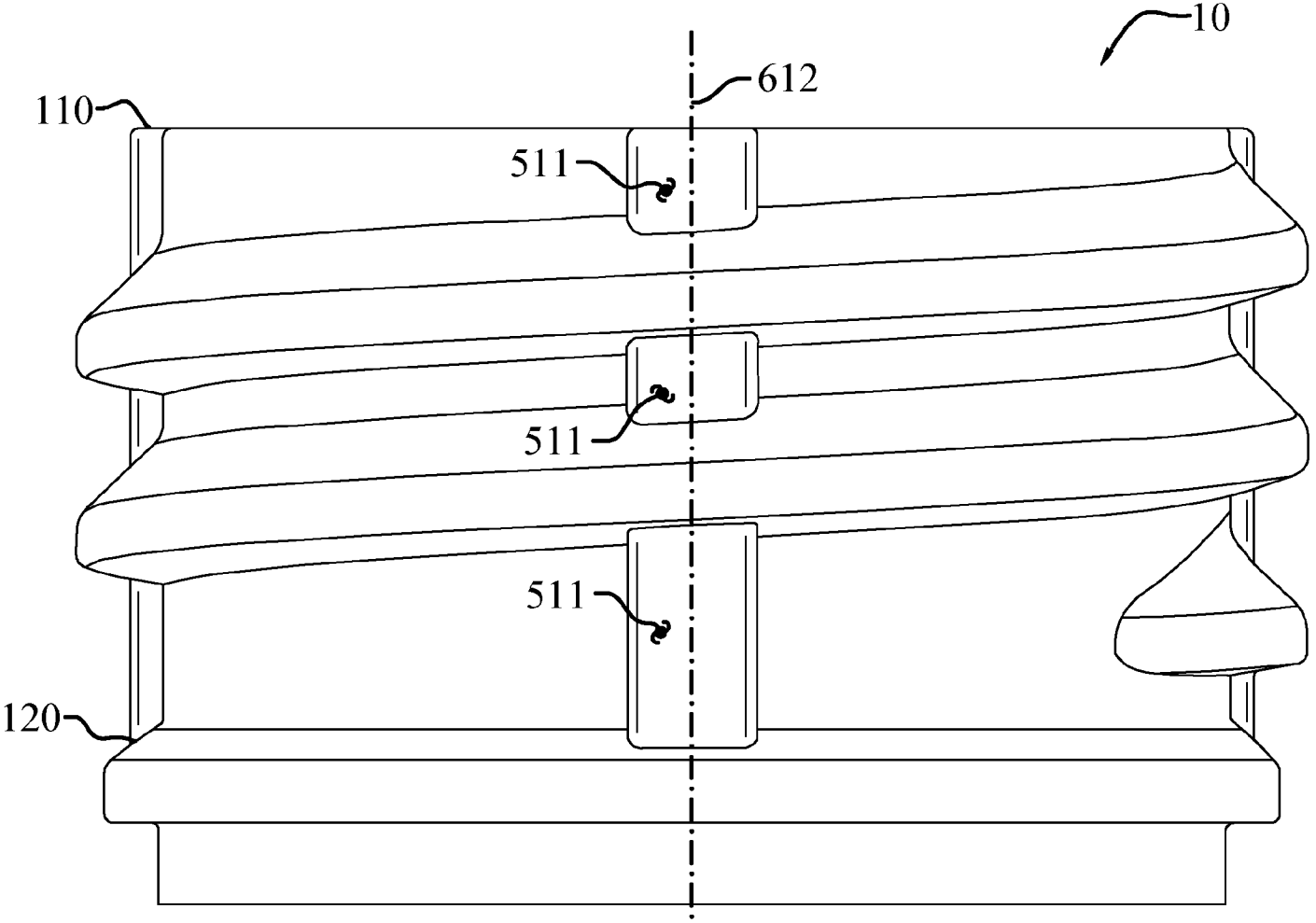
FIG. 4*a* is a side elevation view of an embodiment of a spirally threaded molded bottle neck having areas of reduced wall thickness, not to scale.
Figure 5:
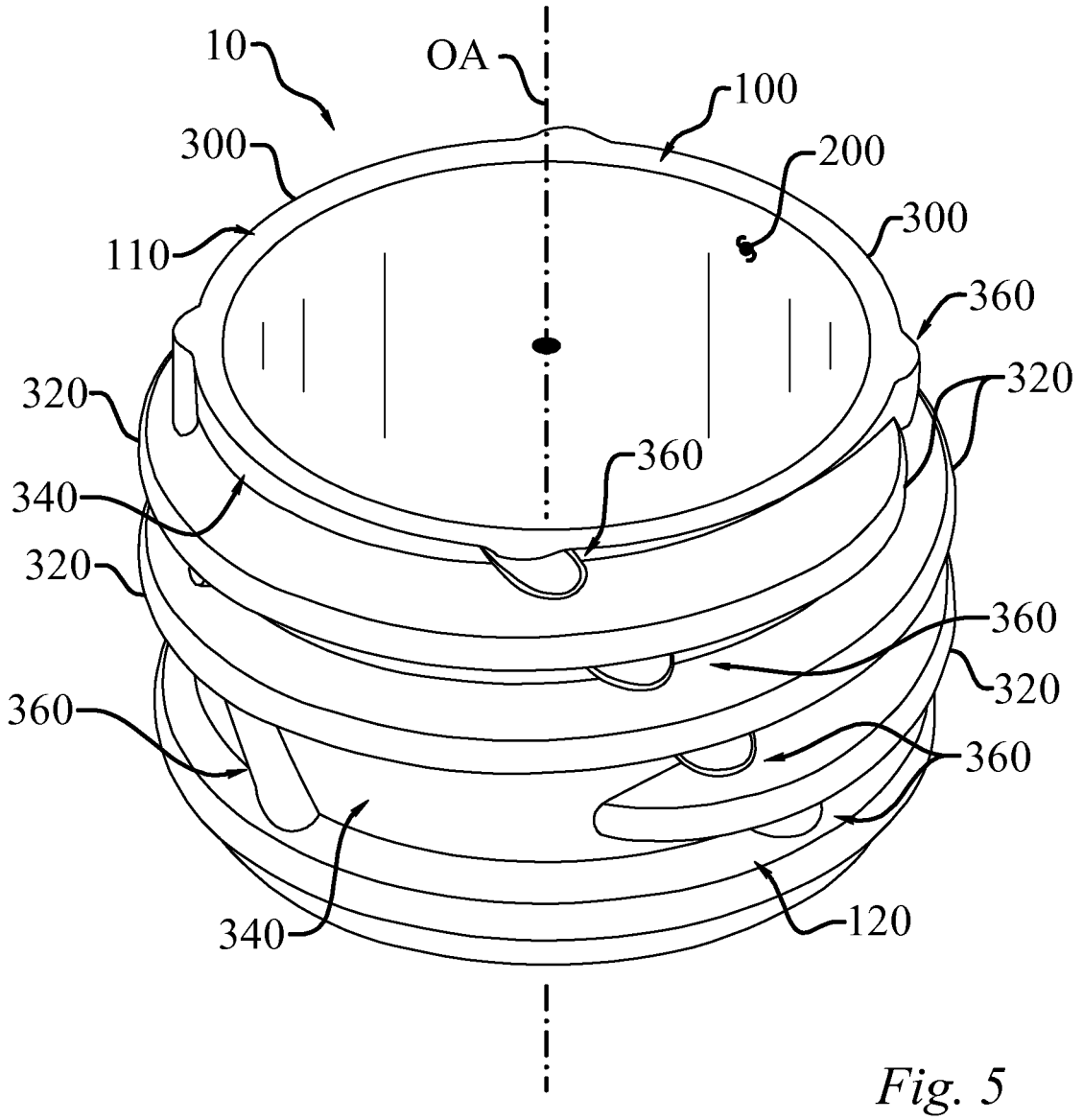
FIG. 5 is a perspective view of an embodiment of a spirally threaded molded bottle neck having areas of reduced wall thickness, not to scale.
Figure 5A:
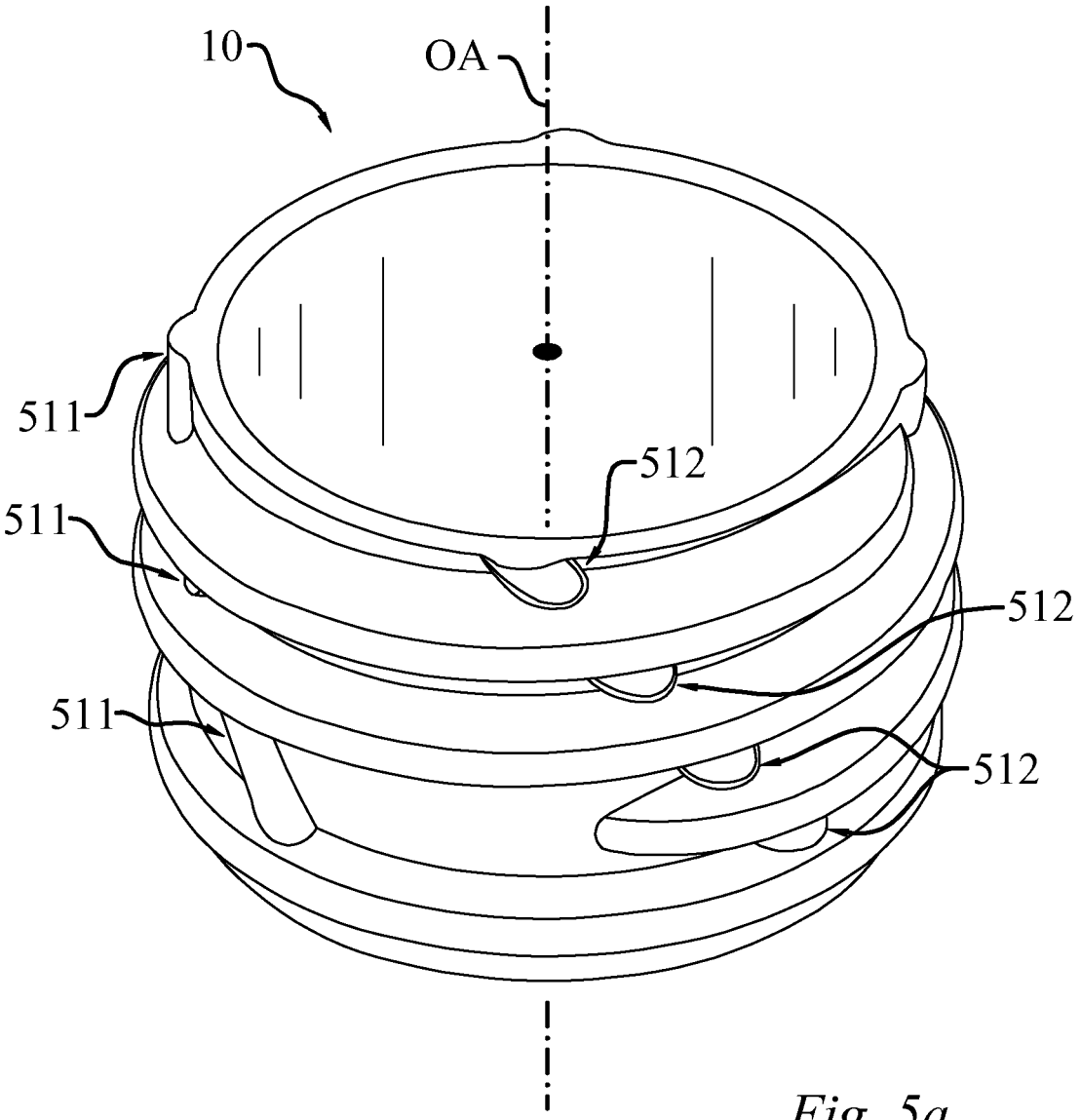
FIG. 5*a* is a perspective view of an embodiment of a spirally threaded molded bottle neck having areas of reduced wall thickness, not to scale.
Figure 6:
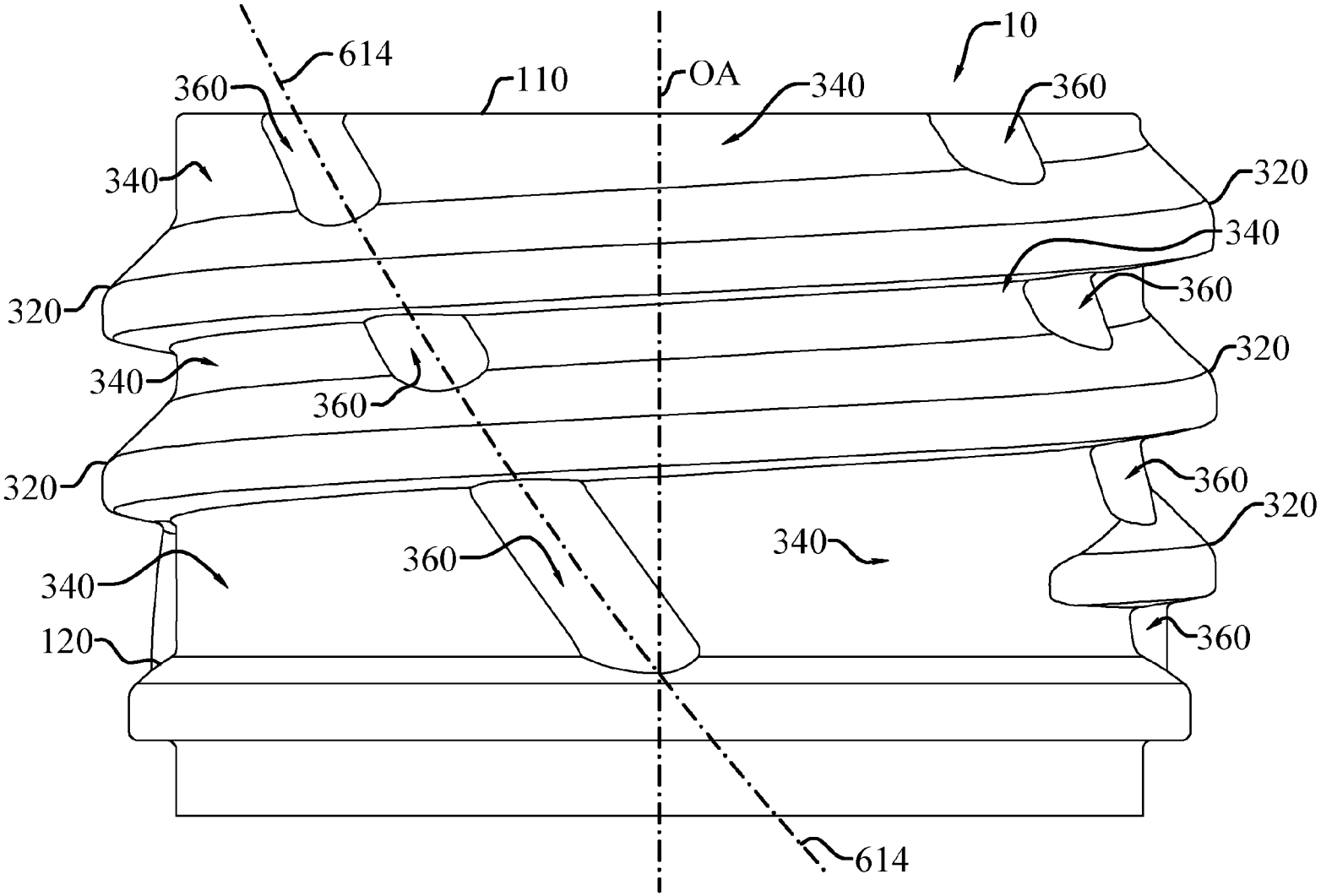
FIG. 6 is a side elevation view of an embodiment of a spirally threaded molded bottle neck having areas of reduced wall thickness, not to scale.
Figure 6A:
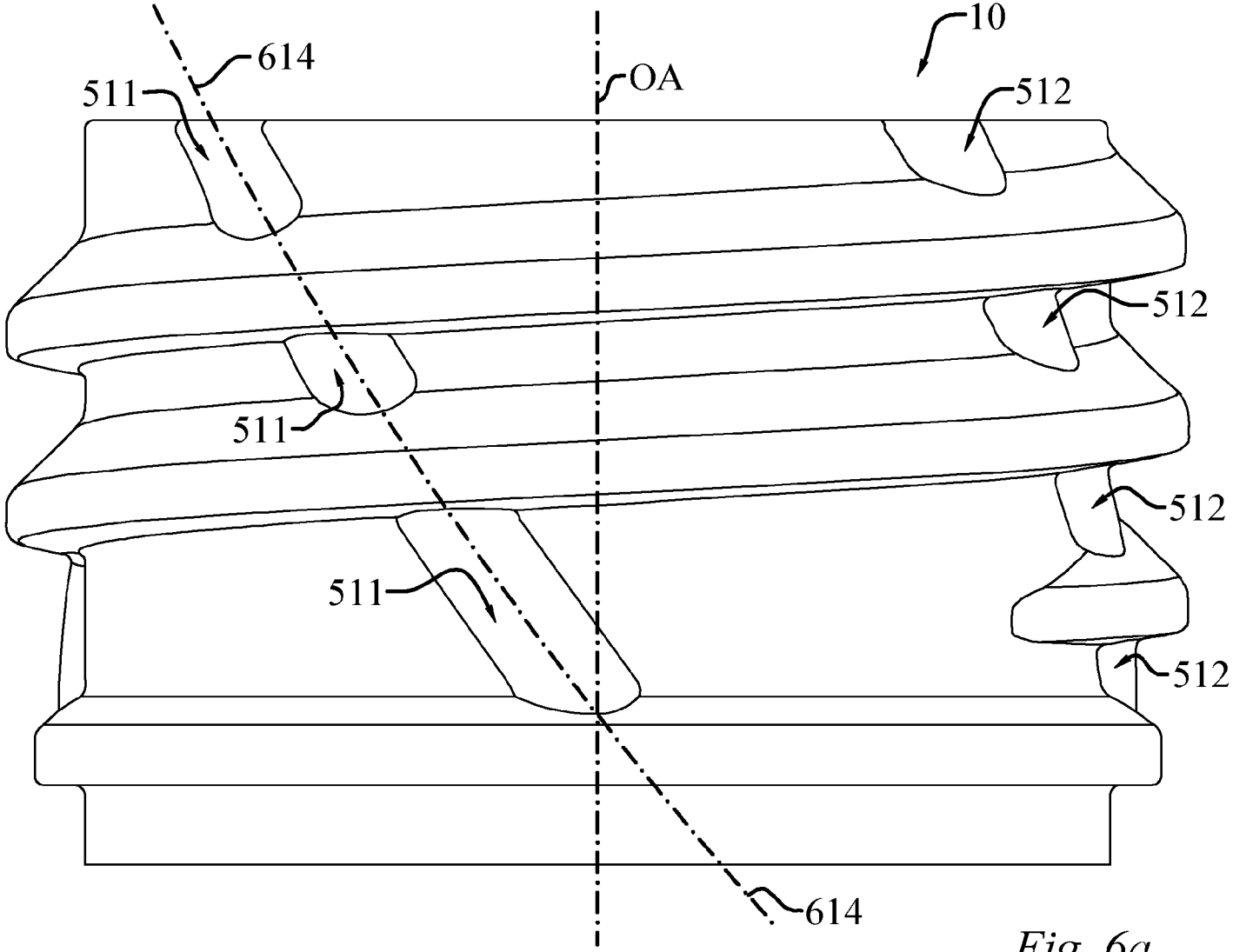
FIG. 6*a* is a side elevation view of an embodiment of a spirally threaded molded bottle neck having areas of reduced wall thickness, not to scale.

As seen in FIG. 2*a*, certain radial spatial relationships defined with respect to axes parallel to the neck opening axis (OA) may be observed between the various areas of second neck thickness (511, 512, 513, 514). In one embodiment, the first area of second neck thickness (511) and the second area of second neck thickness (512) are each symmetrically disposed about a straight line axis of an area of bottle neck wall second thickness (612) that is parallel to the neck opening axis (OA) (i.e., the first area and second area of second neck thickness (511, 512) extend vertically along the bottle neck (10)), seen well in FIGS. 3*a* and 4*a*. In another embodiment demonstrating an additional relationship, the first area of second neck thickness (511) and the second area of second neck thickness (512) are each symmetrically disposed about a spiral axis of an area of bottle neck wall second thickness (614) that is spirally and equidistantly disposed about the neck opening axis (OA), as seen in FIGS. 5*a* and 6*a*. It should be noted that the various areas of second neck thickness (511, 512, 513, 514) may be positioned on the neck exterior surface (300) with arrangements other than the vertical arrangement of FIG. 5*a* and the spiral arrangement of FIG. 6*a*, including, but not limited to an "S" shaped arrangement, a "U" shaped arrangement, and a "V" shaped arrangement, just to name a few.

In a different type of radial spatial relationship, one defined by a plane orthogonal to the neck opening axis (OA), the first area of second neck wall thickness (511) and the second area of second neck wall thickness (512) may be may be radially disposed about the neck opening axis (OA) to be diametrically opposed (i.e., the first area of second neck wall thickness (511) is separated from the second area of second neck wall thickness (512) by 180 degrees). In yet another embodiment, the first area of second neck thickness (511) and the second area of second neck thickness (512) may be radially disposed about the neck opening axis (OA) with at least 120 degrees of radial separation. This embodiment may further include a third area of second neck thickness (513) such that the areas of second neck thickness (511, 512, 513) would tend to divide the diameter of the bottle neck (10) roughly into thirds.

In still another embodiment, the first area of second neck thickness (511) and the second area of second neck thickness (512) may be radially disposed about the neck opening axis (OA) with at least ninety degrees of radial separation. This embodiment may further include a third area of second neck thickness (513) and a fourth area of second neck thickness (514) that are separated by ninety degrees of radial separation such that the areas of second neck thickness (511, 512, 513, 514) tend to divide the diameter of the bottle neck (10) roughly into quarters. In another embodiment, the first area of second neck thickness (511) and the second area of second neck thickness (512) are radially disposed about the neck opening axis (OA) with at least seventy two degrees of radial separation. This embodiment may further include a third area of second neck thickness (513), a fourth area of second neck thickness (514), and a fifth area of second neck thickness (515) that are separated by seventy two degrees of radial separation such that the areas of second neck thickness (511, 512, 513, 514, 515) tend to divide the diameter of the bottle neck (10) roughly into fifths. Additional embodiments are envisioned that utilize additional areas of second neck thickness that are equally radially separated from one another about the bottle neck opening (100). For example, in an embodiment having ten separate areas of second neck thickness, each area of second neck thickness would be radially separated from one another by approximately thirty six degrees. The equal radial separation of the areas of second neck thickness contributes to the rotational balance achieved between the bottle neck (10) and a corresponding closure, which helps ensure proper alignment so that the bottle neck (10) and closure mate properly.

A bottle having the disclosed bottle neck (10) may be constructed of any suitable material, including, but not limited to plastic, metal, or glass, just to name a few. Suitable plastics that may be used include, but are not limited to, polyethylene (high and low density), polypropylene, polyvinyl chloride, polystyrene, polyethylene terephthalate, polyethylene terephthalate G, polycarbonate, and combinations thereof. Additives such as calcium carbonate, fiberglass, or other filler materials may be used with the plastics listed above, if desired. The additives may be included to increase the strength of the plastic, to reduce the amount of plastic used, or for other reasons known to those having skill in the art.

The bottle having the disclosed bottle neck (10) may be manufactured using standard processes. For a plastic bottle having the disclosed bottle neck (10), standard process such as extrusion blow molding, injection blow molding, stretch blow molding, compression blow molding, and injection molding may be utilized, just to name a few.

Numerous alterations, modifications, and variations of the preferred embodiments disclosed herein will be apparent to those skilled in the art and they are all anticipated and contemplated to be within the spirit and scope of the disclosed bottle neck (10). For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the bottle neck (10) are described herein, it is to be understood that the practice of such additional modifications and variations and the equivalents thereof, are within the spirit and scope of the club head as defined in the following claims. The corresponding structures, materials, acts, and equivalents of all means or step plus function elements in the claims below are intended to include any structure, material, or acts for performing the functions in combination with other claimed elements as specifically claimed.

We claim:

1. A screw-type bottle neck having at least two portions of differing bottle neck wall thickness, comprising:

a bottle neck (10) having a neck opening (100), a neck opening axis (OA), an outside neck diameter, a neck interior surface (200), and a neck exterior surface (300), wherein the neck exterior surface (300) includes:

a) at least one spiral thread portion (320) having at least a superior thread aspect (322) and at least an inferior thread aspect (324);

b) at least a first exterior wall interthread portion (340); and c) at least a second exterior wall interthread portion (360); and wherein the bottle neck (10) has at least one area of first neck thickness (410) having a first neck thickness (400) measured orthogonally between a first point on the neck exterior surface (300) in the first exterior wall interthread portion (340) and the neck interior surface (200), and at least one area of second neck thickness (510) having a second neck thickness (500) measured orthogonally between a second point on the neck exterior surface (300) in the second exterior wall interthread portion (360) and the neck interior surface (200); and wherein the second neck thickness (500) is greater than the first neck thickness (400) and the at least one area of non-thread second neck thickness (510) extends laterally beyond the outside neck diameter and does not engage an interior side surface of an applied cap.

2. The device according to claim 1, wherein the at least one area of second neck thickness (510) is continuous with at least one point on the superior thread aspect (322) and one point on the inferior thread aspect (324).

3. The device according to claim 1, wherein the second neck thickness (500) is at least three times greater than the first neck thickness (400).

4. The device according to claim 1, wherein the second neck thickness (500) is at least two times greater than the first neck thickness (400).

5. The device according to claim 1, wherein the second neck thickness (500) is at least 1.1 times greater than the first neck thickness (400).

6. The device according to claim 1, wherein the at least one area of first neck thickness (410) further comprises a first area of first neck thickness (411) and a second area of first neck thickness (412).

7. The device according to claim 1, wherein the at least one area of second neck thickness (510) further comprises at least a first area of second neck thickness (511) and at least a second area of second neck thickness (512).

8. The device according to claim 7, wherein the at least a first area of second neck thickness (511) and the at least a second area of second neck thickness (512) are each symmetrically disposed about a straight line axis of an area of bottle neck wall second thickness (612) that is parallel to the neck opening axis (OA).

9. The device according to claim 7, wherein the at least a first area of second neck thickness (511) and the at least a second area of second neck thickness (512) are each symmetrically disposed about a spiral axis of an area of bottle neck wall second thickness (614) that is spirally and equidistantly disposed about the neck opening axis (OA).

10. The device according to claim 7, wherein the at least a first area of second neck thickness (511) and the at least a second area of second neck thickness (512) are radially disposed about the neck opening axis (OA) to be diametrically opposed.

11. The device according to claim 7, wherein the at least a first area of second neck thickness (511) and the at least a second area of second neck thickness (512) are radially disposed about the neck opening axis (OA) with at least one hundred and twenty degrees of radial separation.

12. The device according to claim 7, wherein the at least a first area of second neck thickness (511) and the at least a second area of second neck thickness (512) are radially disposed about the neck opening axis (OA) with at least ninety degrees of radial separation.

13. The device according to claim 7, wherein the at least a first area of second neck thickness (511) and the at least a second area of second neck thickness (512) are radially disposed about the neck opening axis (OA) with at least seventy two degrees of radial separation.

14. A screw-type bottle neck having at least two portions of differing bottle neck wall thickness, comprising:

a bottle neck (10) having a neck opening (100), a neck opening axis (OA), an outside neck diameter, a neck interior surface (200), and a neck exterior surface (300) having an "E" dimension, wherein the neck exterior surface (300) includes:

a) at least one spiral thread portion (320) having at least a superior thread aspect (322) and at least an inferior thread aspect (324);

b) at least a first exterior wall interthread portion (340); and c) at least a second exterior wall interthread portion (360); and wherein the bottle neck (10) has at least one area of first neck thickness (410) having a first neck thickness (400) measured orthogonally between a first point on the neck exterior surface (300) in the first exterior wall interthread portion (340) and the neck interior surface (200), and a plurality of areas of non-thread second neck thickness (510) having at least a second neck thickness (500) measured orthogonally between a second point on the neck exterior surface in the second exterior wall interthread portion (360) and the neck interior surface (200) in a plurality of spaces between the superior thread aspect (322) and the inferior thread aspect (324) and wherein the plurality of areas of second neck thickness (510) are disposed about an axis (612, 614) that is selected from the group of axes consisting of an axis (612) that is parallel to the neck opening axis (A) and an axis (614 that is spirally and equidistantly disposed about the neck opening axis, wherein the at least a second neck thickness (500) is greater than the first neck thickness (400) and the at least one area each of the plurality of area of second neck thickness (510) extend laterally beyond the outside neck diameter and does not engage an interior side surface of an applied cap.

15. The device according to claim 14, wherein the at least a first area of second neck thickness (511) and the at least a second area of second neck thickness (512) are radially disposed about the neck opening axis (OA) to be diametrically opposed.

16. The device according to claim 14, wherein the at least a first area of second neck thickness (511) and the at least a second area of second neck thickness (512) are radially disposed about the neck opening axis (OA) with at least one hundred and twenty degrees of radial separation.

17. A screw-type bottle neck having at least two portions of differing bottle neck wall thickness, comprising:

a bottle neck (10) having a neck opening (100), a neck opening axis (OA), an outside neck diameter, a neck interior surface (200), and a neck exterior surface (300), wherein the neck exterior surface (300) includes:

a) at least one spiral thread portion (320) having at least a superior thread aspect (322) and at least an inferior thread aspect (324);

b) at least a first exterior wall interthread portion (340); and c) at least a second exterior wall interthread portion (360); and wherein the bottle neck (10) has at least one area of first neck thickness (410) having a first neck thickness (400) measured orthogonally between a first point on the neck exterior surface (300) in the first exterior wall interthread portion (340) and the neck interior surface (200), and at least one area of second neck thickness (510) having a second neck thickness (500) measured orthogonally between a second point on the neck exterior surface (300) in the second exterior wall interthread portion (360) and the neck interior surface (200); and wherein the second neck thickness (500) is greater than the first neck thickness (400) and the at least one area of second neck thickness (510) extends laterally beyond the outside neck diameter of the spiral thread portion (320) and does not engage an interior side surface of an applied cap; and the at least one area of second neck thickness (510) further comprises at least a first area of second neck thickness (511) and at least a second area of second neck thickness (512), wherein the at least a first area of second neck thickness (511) and the at least a second area of second neck thickness (512) are each symmetrically disposed along a spiral axis of an area of bottle neck wall second thickness (614) that is spirally and equidistantly disposed about the neck opening axis (OA).

18. The device according to claim 17, wherein the at least a first area of second neck thickness (511) and the at least a second area of second neck thickness (512) are radially disposed about the neck opening axis (OA) to be diametrically opposed.

19. The device according to claim 17, wherein the at least a first area of second neck thickness (511) and the at least a second area of second neck thickness (512) are radially disposed about the neck opening axis (OA) with at least one hundred and twenty degrees of radial separation.

20. The device according to claim 17, wherein the at least one area of second neck thickness (510) further comprises at least two areas of differing second neck thickness (500).

* * * * *